US010017886B2

(12) United States Patent
Tompkins et al.

(10) Patent No.: US 10,017,886 B2
(45) Date of Patent: Jul. 10, 2018

(54) SCRIM MACHINE

(71) Applicant: Milliken & Company, Spartanburg, SC (US)

(72) Inventors: Michael Tompkins, Cherryville, NC (US); Frank M. Pitman, Duncan, SC (US)

(73) Assignee: Milliken & Company, Spartanburg, SC (US)

( * ) Notice: Subject to any disclaimer, the term of this patent is extended or adjusted under 35 U.S.C. 154(b) by 311 days.

(21) Appl. No.: 15/164,285

(22) Filed: May 25, 2016

(65) Prior Publication Data

US 2017/0342616 A1 Nov. 30, 2017

(51) Int. Cl.
*D04H 3/04* (2012.01)
*D04H 3/12* (2006.01)

(52) U.S. Cl.
CPC ..... *D04H 3/04* (2013.01); *D04H 3/12* (2013.01)

(58) Field of Classification Search
CPC ..... D04H 3/04; D04H 3/12; D04H 37/00
USPC ..... 28/101
See application file for complete search history.

(56) References Cited

U.S. PATENT DOCUMENTS

| | | | | |
|---|---|---|---|---|
| 3,422,511 | A * | 1/1969 | Seguin | B29C 70/202 156/177 |
| 3,608,164 | A | 9/1971 | Bolles | 28/1 |
| 4,242,779 | A | 1/1981 | Curinier et al. | 28/101 |
| 4,369,554 | A | 1/1983 | Curinier et al. | 28/101 |
| 8,323,437 | B2 | 12/2012 | Scholten et al. | 156/190 |

* cited by examiner

*Primary Examiner* — Scott W Dodds
(74) *Attorney, Agent, or Firm* — Cheryl J. Brickey

(57) ABSTRACT

A machine for non-woven fabric formation containing a rotating center shaft, at least a first and second pair of laterally spaced, interchangeable helical yarn guides, a yarn feeding wheel assembly, a fabric take up. The machine is capable of forming both square and tri-axial scrims with changes to the interchangeable helical yarn guides and yarn feeding wheel assembly.

13 Claims, 5 Drawing Sheets

SCRIM MACHINE

TECHNICAL FIELD OF THE INVENTION

The invention provides a machine for making non-woven fabric, more particularly a machine for making a scrim fabric.

BACKGROUND

Open non-woven fabrics, often referred to as scrims have many industrial applications such as in house wraps, roofing membranes, tapes, and cementitious materials. There are two main types of laid non-woven scrims (where the yarns are held together by an adhesive means), a square pattern scrim and a tri-axial pattern scrim. Typically, there is a machine to make a square pattern scrim and a separate machine with a different design to make a tri-axial pattern scrim. There is a need for one machine to be able to easily produce both types of scrim.

BRIEF SUMMARY OF THE INVENTION

A machine for non-woven fabric formation containing a rotating center shaft, at least a first and second pair of laterally spaced, interchangeable helical yarn guides, a yarn feeding wheel assembly, a fabric take up. The machine is capable of forming both square and tri-axial scrims with changes to the interchangeable helical yarn guides and yarn feeding wheel assembly.

The machine for non-woven fabric formation contains a rotating center shaft having a longitudinal axis, a first end, and a second end and the rotating center shaft rotates about its longitudinal axis.

The machine also contains at least a first and second pair of laterally spaced, interchangeable helical yarn guides, where only one pair of helical yarn guides is installed in the machine at a time. Each yarn guide has a longitudinal axis, a length along the longitudinal axis, a front end, and a back end. The first pair of helical yarn guides each contain a first yarn insertion point located along the length of the first helical guides and the second pair of helical yarn guides each contain a second yarn insertion point located along the length of the second helical guides. The longitudinal axes of the helical yarn guides are parallel to the longitudinal axis of the center shaft and the center shaft is between the pair of helical yarn guides. The helical yarn guides within each pair have the same length and the same yarn insertion point and the yarn insertion points for the first pair of yarn guides are closer to the first end of the center shaft than the yarn insertion points for the second pair of yarn guides. Each helical yarn guide rotates about its respective longitudinal axis. The machine also contains a yarn feeding wheel assembly which contains at least a first yarn feeding wheel and a plurality of yarn package holders. The first yarn feeding wheel has a generally circular shape and a circumference, rotates about the center shaft, and contains a plurality of yarn feed points spaced about the circumference of the feeding wheel.

In the case where the wheel assembly comprises only the first yarn feeding wheel, the first yarn feeding wheel is movable in the direction along the longitudinal axes of the pair of helical yarn guides from approximately the first yarn insertion point to approximately the second yarn insertion point. In the case where the assembly comprises the first yarn feeding wheel and a second feeding wheel, the first yarn feeding wheel is located at approximately the first yarn insertion point and the second feeding wheel is located at approximately the second yarn insertion point.

The machine also contains a fabric take up which contains least one roller having a longitudinal axis and a length along the longitudinal axis. The longitudinal axis of the fabric take up is perpendicular to the longitudinal axes of the helical yarn guides and wherein the length of the fabric take up is at least as large as the distance between the pair of helical yarn guides.

DETAILED DESCRIPTION OF THE INVENTION

Figure 1:
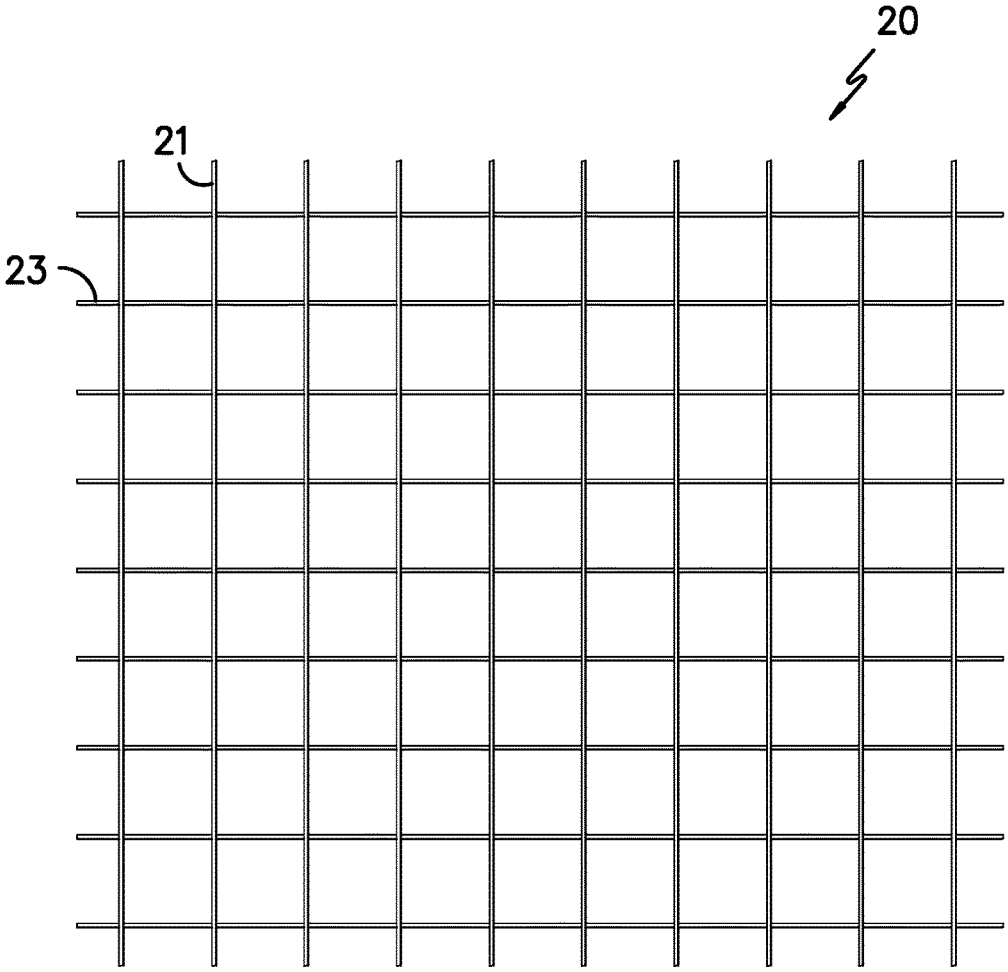
FIG. 1 is an illustration of a square scrim.
Figure 2:
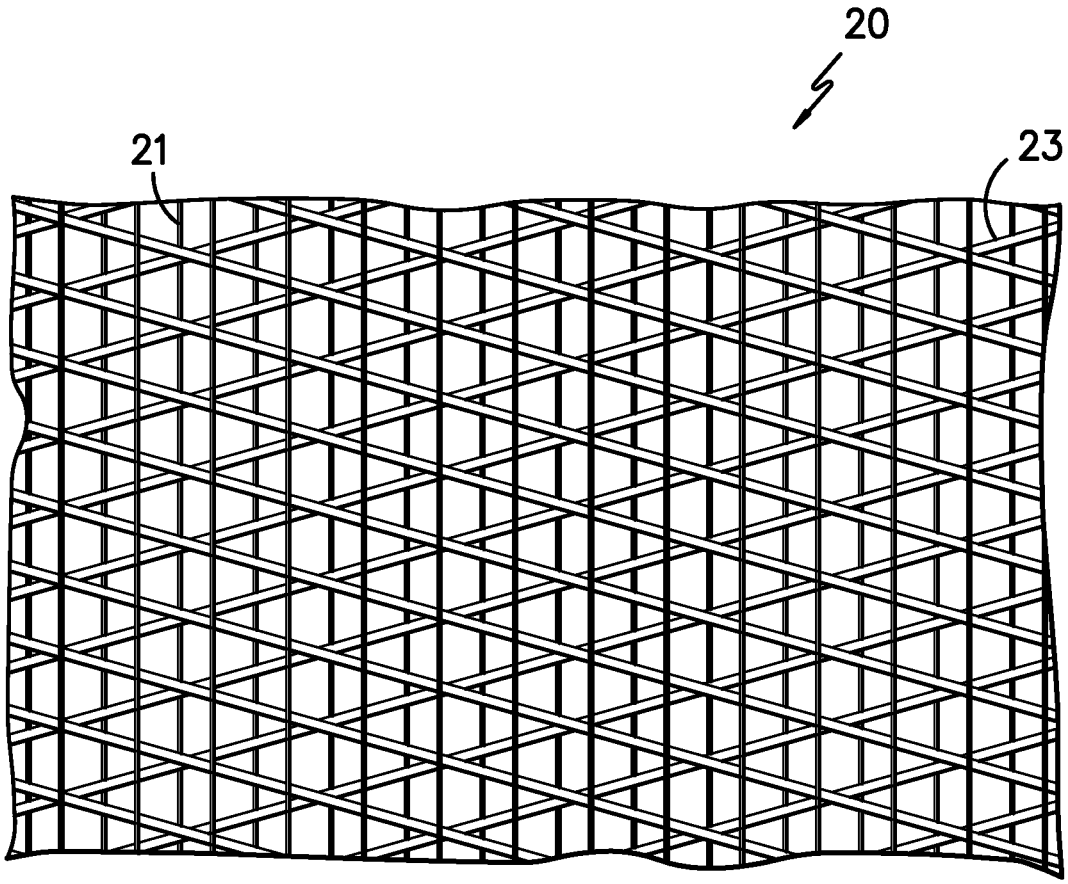
FIG. 2 is an illustration of a tri-axial scrim.

The present invention is for a machine that is able to produce both types of popular laid scrims, a square pattern scrim and a tri-axial pattern scrim. An illustration of one type of square scrim is shown in FIG. 1 and an illustration of one type of tri-axial scrim is shown in FIG. 2. The warp yarns 21 of both the square and tri-axial scrims run along a first direction (the machine direction). In the square pattern, the weft yarns 23 are at approximately right angles to the warp yarns, typically between from about 85 and 95 degrees of the warp yarns 21 (the goal is to typically have the yarns be as close to 90 degrees as possible).

Both square and tri-axial scrim machines contain a set of weft yarn packages and a wheel that guides the weft yarns into two screws (yarn guides). As the wheel rotates the yarns are wound around the screws which extend through the yarn path and define the width of the fabric. These screws are rotating and as they rotate the yarn travels down their length and is eventually released on to two carrier yarns that travel through the center of each screw. The pitch of the screws at the point they release the yarn determines the spacing of the weft yarns. A set of warp yarns are fed in in the machine direction from the bottom of the machine, and another set of warp yarns are fed in from the top of the machine. The two sets of warp yarns sandwich the weft yarns as soon as the weft yarns are released from the screw, and both warp and weft travel to a fabric take up where they typically travel over a roll and through a glue bath and pad adhering the fabric together.

In both machines it is important for fabric geometry to be maintained that the end of the screws (yarn guides) be very close to the fabric take up. Preferably, the distance from the pad which applies a glue to the first steam can which dries and cures the glue should be kept short. Any additional distance may allow the fabric time to shift.

In a square pattern scrim machine the goal is to get the weft yarns as close as perpendicular to the warp yarns as possible. This is accomplished by keeping the number of ends on the large wheel small (typically 3, 5, 7) and spinning the wheel fast relative to the speed of the warp yarns. In a typical style for every revolution of the wheel the warp moves one inch. The screws (yarn guides) that hold the yarns are kept short so that they reach the glue as soon as possible.

In a tri-axial pattern machine the goal is to provide a fabric where the weft yarns are laid at a steep angle (about 60 degrees) to the warp yarns with the top weft being in +60 degrees and the bottom being −60 degrees (plus or minus about 15 degrees). A typical tri-axial machine has many ends on the wheel (sometimes 64 or more) and turns the wheel slowly relative to the speed of the warp yarns. Typically for every rotation the warp yarns will travel a distance equal to its width. The screws in the tri-axial machines are much longer than the square machines, but still end close to the fabric take up so the fabric can immediately be glued together.

In order to make a machine produce both square and tri-axial scrims, the machine had to be able to accommodate all of the above parameters. The machine uses two different types of yarn guides and either two different wheels or one movable wheel.

In the tri-axial scrim (also known as tri-directional), there are three sets of yarns: one set of warp yarns 21 running in a machine direction and two sets of weft yarns 23, a first set having both an upward diagonal slope and a second set having a downward diagonal slope. Previously, machine were developed to create one type of scrim or the other, having one machine able to produce both types of scrims would be advantageous.

Figure 3:
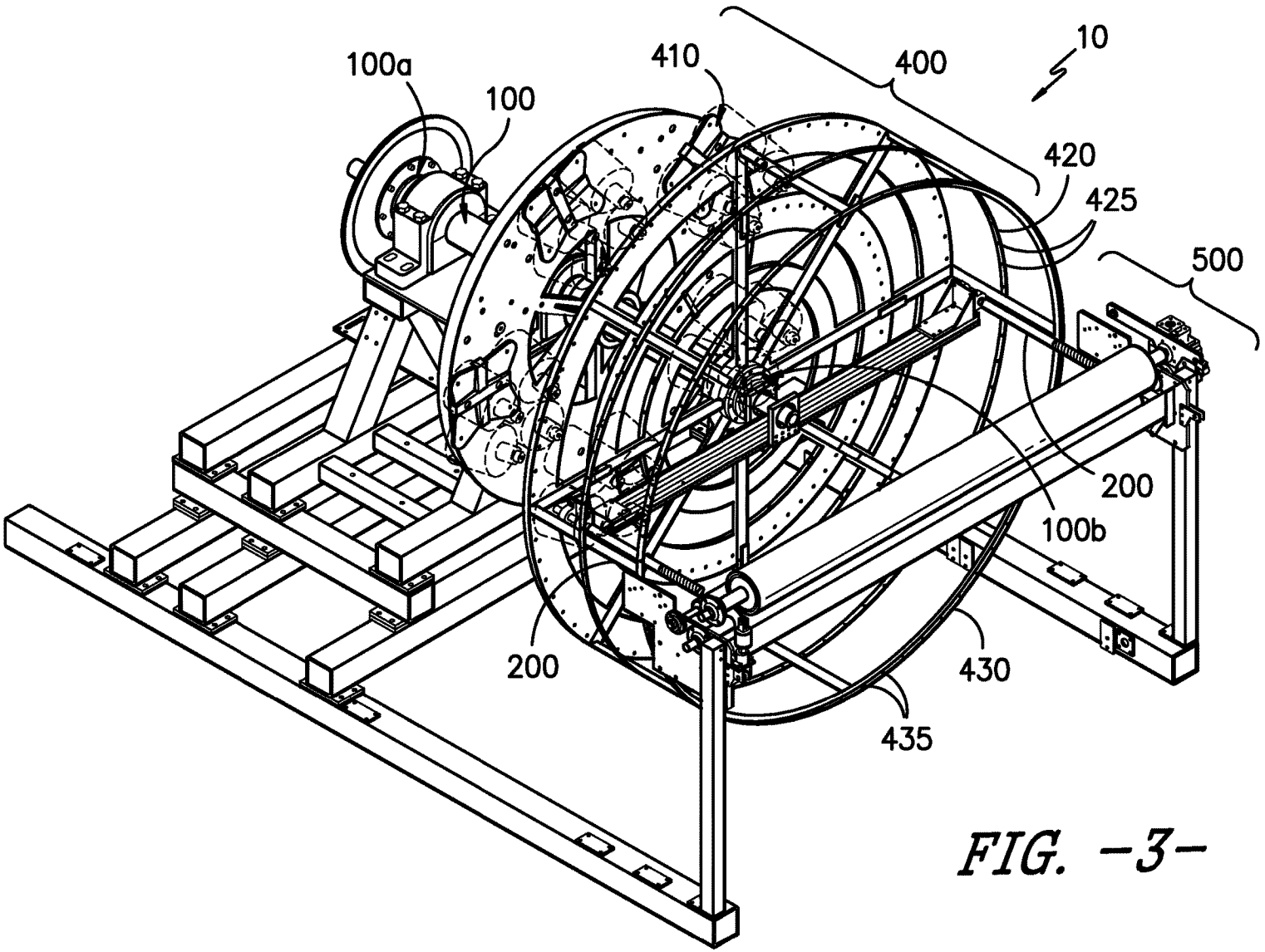
FIG. 3 is an illustration of one embodiment of the machine to produce both types of popular laid scrims, a square pattern scrim and a tri-axial pattern scrim.

Referring now to FIG. 3, there is shown one embodiment of the machine for non-woven fabric formation 10 (referred to herein as the "machine"). The machine 10 contains a rotating center shaft 100 having a longitudinal axis, a first end 100*a* and a second end 100*b*.

The machine 10 also contains at least a first pair of laterally spaced, interchangeable helical yarn guides 200 and second pair of laterally spaced, interchangeable helical yarn guides 300 (not shown in FIG. 3). Only one pair of helical yarn guides (200, 300) is installed in the machine 10 at a time. Each yarn guide (200, 300) has a longitudinal axis and a length along the longitudinal axis.

Figure 4:
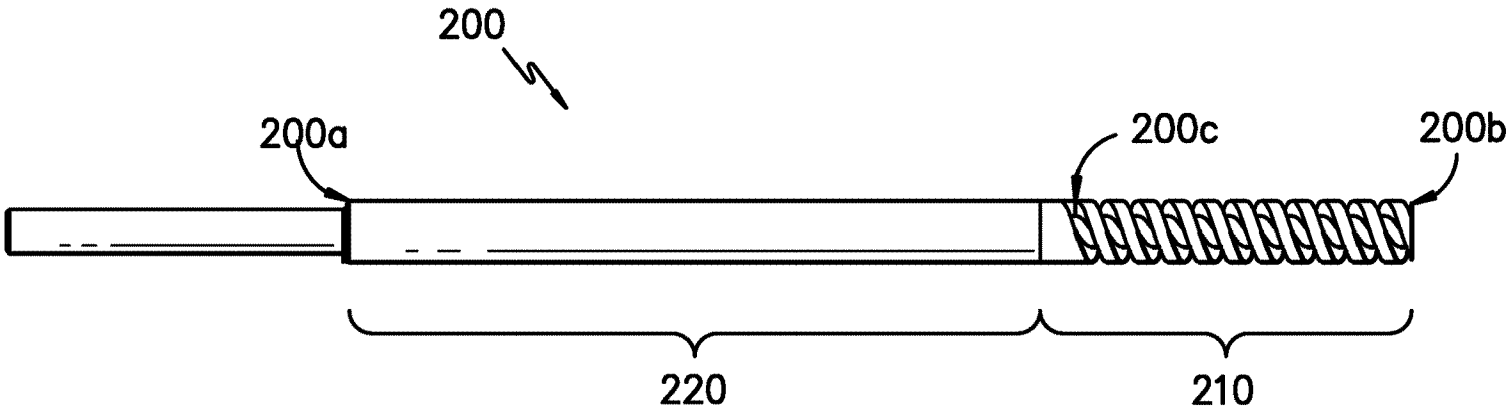
FIGS. 4 and 5 are illustrations of different helical yarn guides.
Figure 5:
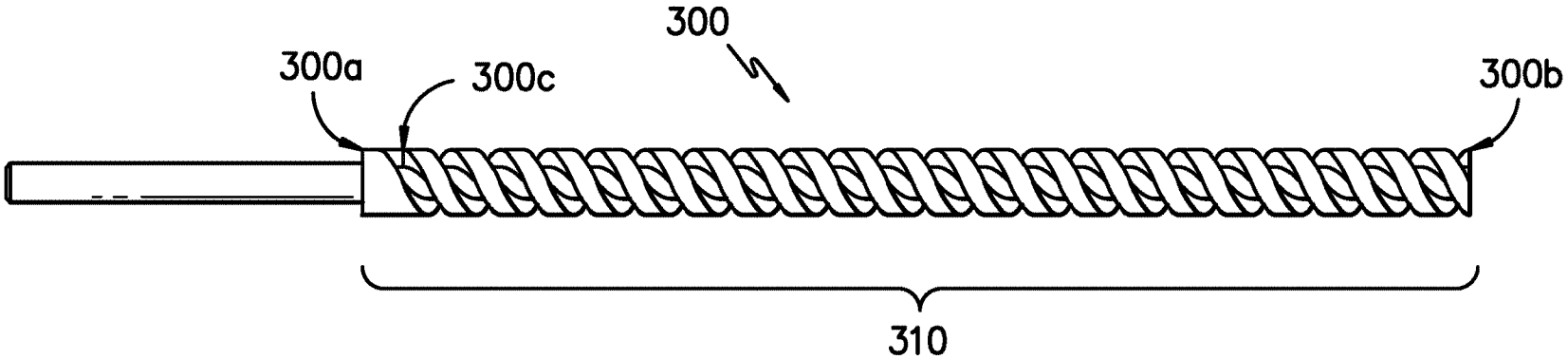

Referring to FIG. 4, the first pair of helical yarn guides 200 has a front end 200*a*, a back end 200*b*, and a yarn insertion point 200*c* located at a point along the length of the guide between the front end 200*a* and the back end 200*b*. Referring to FIG. 5, the second pair of helical yarn guides 300 has a front end 300*a*, a back end 300*b*, and a yarn insertion point 300*c* located at a point along the length of the guide between the front end 300*a* and the back end 300*b*.

Referring back to FIG. 3, the first pair of helical guides 200 are installed in the machine 10 such that the longitudinal axes of the helical yarn guides 200 are parallel to the longitudinal axis of the center shaft 100 and the center shaft 100 is located between the pair of helical yarn guides 200. The center shaft 100 being located between the pair of helical yarn guides 200 does not mean that the shaft 100 has to lie within the same plane as the yarn guides 200, it must be located (looking down at the machine from above), between the two yarn guides 200. Preferably, the center shaft 100 and the yarn guides 200, 300 lie in the same plane.

The helical yarn guides 200, 300 within each pair of yarn guides have essentially the same length and essentially the same yarn insertion point (essentially in this application being defined to be within 5%). Each helical yarn guide 200, 300 rotates about its respective longitudinal axis and the first yarn insertion points 200*c* for the first yarn guides 200 are closer to the first end 100*a* of the center shaft 100 than the yarn insertion points 300*c* for the second pair of yarn guides 300.

The machine 10 also contains a yarn feeding wheel assembly 400. The yarn feeding wheel assembly 400 contains at least a first yarn feeding wheel 420 and a plurality of yarn package holders 410. The first yarn feeding wheel 420 has a generally circular shape and a circumference and wheel rotates about the center shaft 100. The first yarn feeding wheel 420 a plurality of yarn feed points 425 spaced about the circumference of the feeding wheel. Preferably, the plurality of yarn feed points 425 are spaced approximately equidistant about the circumference of the first feeding wheel 420. In one embodiment, the yarn package holders 410 are on a separate wheel that is independently rotatable from the first feeding wheel 420 and second feeding wheel 430. The package holders serve to deliver the weft yarns to the first or second feeding wheel 420, 430.

In one embodiment, the wheel assembly 400 comprises only the first yarn feeding wheel 420 which is movable in the direction along the longitudinal axes of the pair of helical yarn guides 200 from approximately the first yarn insertion point 200*c* to approximately the second yarn insertion point 300*c*.

In another embodiment, the assembly 400 contains the first yarn feeding wheel 420 and a second feeding wheel 430. The first yarn feeding wheel 420 a plurality of yarn feed points 425 spaced about the circumference of the first feeding wheel 420 and the second yarn feeding wheel 430 a plurality of yarn feed points 435 spaced about the circumference of the second feeding wheel 430. The first yarn feeding wheel 420 is located at approximately the first yarn insertion point 200*a* on the first helical yarn guides 200 and the second feeding wheel is located at approximately the second yarn insertion point 300*c* on the second helical yarn guides. Preferably, the plurality of yarn feed points 435 are spaced approximately equidistant about the circumference of the second feeding wheel 430. In the case where there is more than one feeding wheel, preferably the weft yarns from the yarn packages 410 are only delivered to one of the feed wheels 410 or 420. The feed wheel not in use may threaded, unthreaded, may rotate with the feed wheel in use or not rotate at all, or may even be removed from the machine 10.

The machine 10 further includes a fabric take up 500, where the fabric take comprises at least one roller having a longitudinal axis and a length along the longitudinal axis. The longitudinal axis of the fabric take up is perpendicular to the longitudinal axes of the helical yarn guides 200, 300 and the rotating center shaft 100. The length of the fabric take up is at least as large as the distance between the pair of helical yarn guides. Preferably, the fabric take up 500 contains an adhesive (or glue) applicator that applies adhesive to the weft and warp yarns to hold them in place relative to one another which is approximately parallel to the other rollers in the fabric take up 500. Any suitable adhesive or glue may be used, including but not limited to aqueous based adhesives, UV curable adhesives, solvent based adhesives, or melted adhesives. Any suitable application method may be used, for example, a spray coater, dip coater, kiss coater, knife coater, curtain coater, and inkjet coater. Additionally, the fabric take up 500 also includes a drying mechanism which may be hot air, steam filled rollers, ovens, UV light, or any other suitable mechanism to dry or cure the adhesive. Preferably, the fabric tape up 500 includes a wind up to wind up the finished scrim fabric at the end of the fabric take up.

Referring now to FIG. 4, one of the first pair of helical yarn guides 200 is shown. These yarn guides are also sometimes referred to as screws in the industry. The helical yarn guide 200 is preferably used in combination with the second feeding wheel where the second feeding wheel at approximately the first yarn insertion point 200*c* along the first yarn guide 200. In the case where there is only one wheel, the wheel moved is preferably moved to be at approximately the first yarn insertion point 200*c* along the first yarn guide 200. This set up will produce a square pattern scrim.

Preferably, the first yarn guides 200 have a helical section and an extender section. The extender section 220 extends from the front end 200*a* of the helical yarn guide 200 to the first yarn insertion point 200*c* and the helical section 210 extends from the first yarn insertion point 200*c* to the back end 200*b* of the helical yarn guide 200. This extender section 220 has the purpose to make sure that the back end 200*b* of the yarn guide 200 is the proper closeness to the fabric take up 500.

This is also shown in FIG. 3 where the machine 10 has yarn guides 200 installed. In this embodiment, the feed wheel that would be threaded and used would be the second wheel 430 such that the weft yarns were feed into the yarn insertion point 200*c* of the first guides 200.

Referring now to FIG. 5, one of the second pair of helical yarn guides 300 is shown. The helical yarn guide 300 is preferably used in combination with the first feeding wheel where the first feeding wheel at approximately the second yarn insertion point 300*c* along the first yarn guide 300. In the case where there is only one wheel, the wheel moved is preferably moved to be at approximately the second yarn insertion point 300*c* along the second yarn guide 300. This set up will produce a tri-axial pattern scrim.

Figure 6:
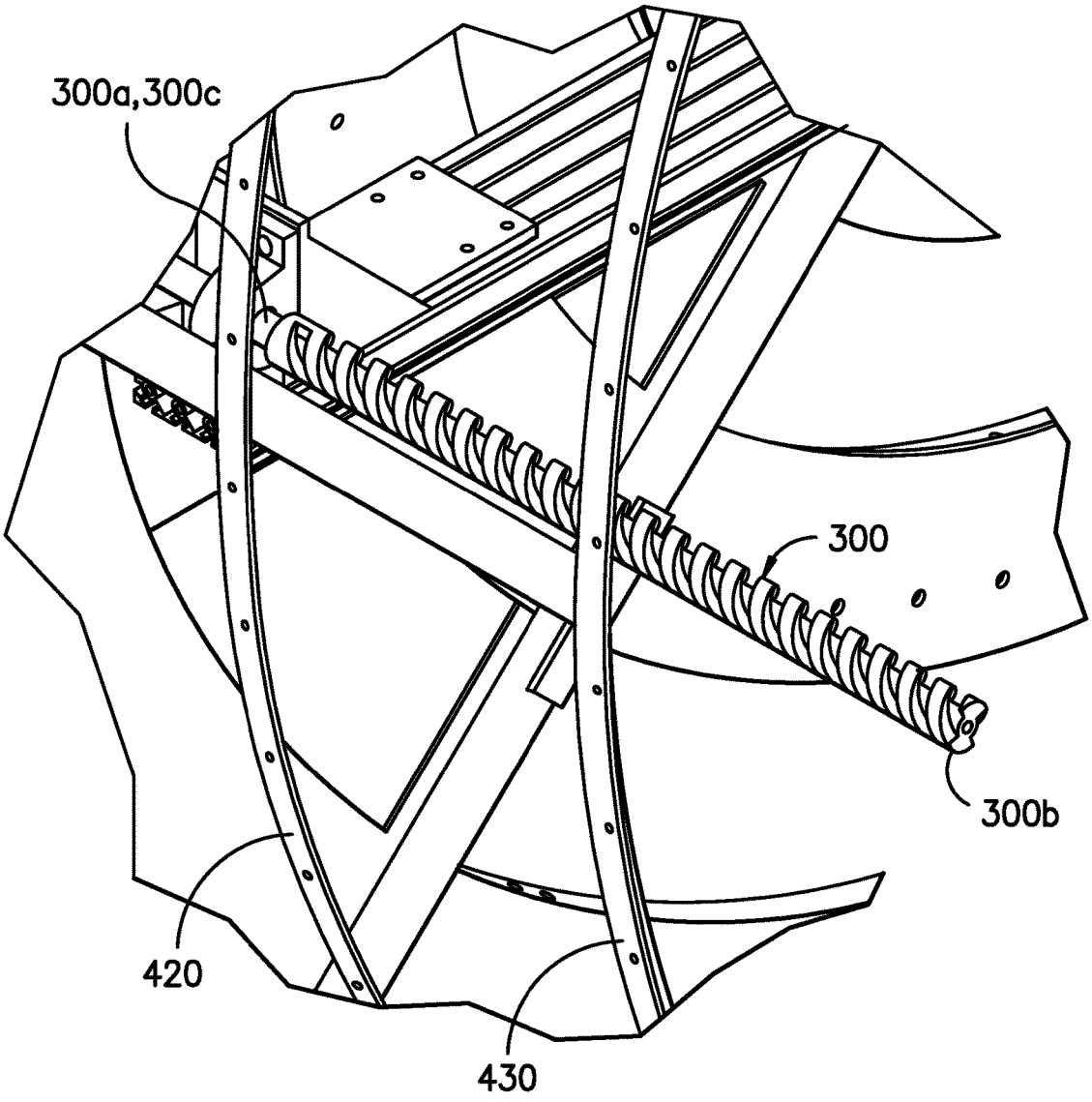
FIG. 6 is an enlarged illustration of one embodiment of the machine to produce both types of popular laid scrims, a square pattern scrim and a tri-axial pattern scrim.

This is also shown in FIG. 6 where in the expanded view, the machine 10 has yarn guides 300 installed. In this embodiment, the feed wheel that would be threaded and used would be the first wheel 420 such that the weft yarns were feed into the second yarn insertion points 300*c* of the guides 300.

Preferably, the second yarn guides 300 have a helical section 310 and little to no extender section. In FIG. 5, there is no extender section and the front end 300*a* of the second yarn guide 300 is at approximately the same location along the length of the yarn guide as the insertion point 300*a*. Preferably, the helical section 310 of the second yard guide 300 is approximately equal to the length of the second yarn guide 300.

Preferably, the helical section 210, 310 of the yarn guides 200, 300 have a helical screw configuration. This screw configuration guides the weft yarns down the yarn guide and helps control spacing the weft yarns as well as the angle of the weft yarns in relationship to the warp yarns.

Preferably, the distance between the back ends 200*b*, 300*b* of the first and second yarn guides 200, 300 and the fabric take up 500 is approximately equal. This makes the yarn guides 200, 300 easier to interchange in the machine 10 with as few modifications as possible. Additionally to make the yarn guides 200, 300 easier to change out, the length (total length including both extender and helical sections) of the yarn guides 200, 300 are approximately the same.

Preferably, the first yarn guides 200 and the second yarn guides 300 have approximately the same total length (from the front end 200*a*, 300*a* to the back end 200*b*, 300*b*). In one embodiment, the yarn guides 200, 300 have a total length of about 30 to 60 inches, more preferably about 30 and 54 inches. In one embodiment, the first yarn guides 200 have a helical section 210 with a length of between about 10 and 20 inches. In one embodiment, the first yarn guides 200 have an extender section 220 with a length of between about 10 and 50 inches. The helical section 210 of the first yarn guides 200 preferably has a screw pitch of between about 0.5 and 5 yarns per inch. The helical section 310 of the second yarn guides 300 preferably has a screw pitch of between about 1 and 10 yarns per inch. In one embodiment, the length of the helical section first pair of yarn guides is about 20 to 80% of the length of the helical section of the second pair of yarn guides. In another embodiment, the length of the helical section first pair of yarn guides is about 30 to 70% of the length of the helical section of the second pair of yarn guides.

The machine 10 preferably comprises a plurality of warp yarn guides configured to deliver warp yarns, where the warp yarns are delivered such that they are approximately parallel to the yarn guides 200, 300. The warp yarns preferably are feed such that they come down from the top and bottom of the machine and sandwich the weft yarns. The warp yarn spacing can be any suitable spacing, in one embodiment there are between 0.5 and 10 yarns per inch.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the subject matter of this application (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the subject matter of the application and does not pose a limitation on the scope of the subject matter unless otherwise claimed. No language in the specification should be construed as indicating any non-claimed element as essential to the practice of the subject matter described herein.

Preferred embodiments of the subject matter of this application are described herein, including the best mode known to the inventors for carrying out the claimed subject matter. Variations of those preferred embodiments may become apparent to those of ordinary skill in the art upon reading the foregoing description. The inventors expect skilled artisans to employ such variations as appropriate, and the inventors intend for the subject matter described herein to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the present disclosure unless otherwise indicated herein or otherwise clearly contradicted by context.

What is claimed is:

1. A machine for non-woven fabric formation, comprising:

a rotating center shaft having a longitudinal axis, a first end, and a second end, wherein the rotating center shaft rotates about its longitudinal axis;

at least a first and second pair of laterally spaced, interchangeable helical yarn guides, wherein only one pair of helical yarn guides is installed in the machine at a time, wherein each helical yarn guide has a longitudinal axis, a length along the longitudinal axis, a front end, a back end, wherein the first pair of helical yarn guides each comprise a first yarn insertion point located along the length of the first helical yarn guides and the second pair of helical yarn guides each comprise a second yarn insertion point located along the length of the second helical yarn guides, wherein the longitudinal axes of the helical yarn guides are parallel to the longitudinal axis of the center shaft, wherein the center shaft is between the pair of helical yarn guides, wherein the helical yarn guides within each pair have the same length and the same yarn insertion point, wherein each helical yarn guide rotates about its respective longitudinal axis, and wherein the yarn insertion points for the first pair of helical yarn guides are closer to the first end of the center shaft than the yarn insertion points for the second pair of helical yarn guides;

a yarn feeding wheel assembly comprising at least a first yarn feeding wheel and a plurality of yarn package holders, wherein the first yarn feeding wheel has a generally circular shape and a circumference, wherein the first yarn feeding wheel rotates about the center shaft, and wherein the first yarn feeding wheel comprises a plurality of yarn feed points spaced about the circumference of the feeding wheel, wherein in the case where the wheel assembly comprises only the first yarn feeding wheel, the first yarn feeding wheel is movable in the direction along the longitudinal axes of the pair of helical yarn guides from approximately the first yarn insertion point to approximately the second yarn insertion point, wherein in the case where the assembly comprises the first yarn feeding wheel and a second feeding wheel, the first yarn feeding wheel is located at approximately the first yarn insertion point and the second feeding wheel is located at approximately the second yarn insertion point, a fabric take up, wherein the fabric take up comprises at least one roller having a longitudinal axis and a length along the longitudinal axis, wherein the longitudinal axis of the fabric take up is perpendicular to the longitudinal axes of the helical yarn guides, and wherein the length of the fabric take up is at least as large as the distance between the pair of helical yarn guides.

2. The machine of claim 1, wherein the helical yarn guides and center shaft lie in the same plane.

3. The machine of claim 1, wherein the helical yarn guides comprise a helical section and an optional extender section.

4. The machine of claim 3, wherein the helical section of at least one pair of the helical yarn guides is approximately equal to the length of the helical yarn guides.

5. The machine of claim 3, wherein at least one pair of the helical yarn guides comprise the helical section and the extender section, wherein the extender section extends from the front end of the helical yarn guides to approximately the yarn insertion point and the helical section extends from approximately the yarn insertion point to the back end of the helical yarn guides.

6. The machine of claim 3, wherein the length of the helical section of the first pair of helical yarn guides is about 20 to 80% of the length of the helical section of the second pair of helical yarn guides.

7. The machine of claim 3, wherein the length of the helical section of the first pair of helical yarn guides is about 10 to 20 inches.

8. The machine of claim 3, wherein the helical section of the helical yarn guides comprises a helical screw configuration.

9. The machine of claim 1, wherein the first and second pairs of helical yarn guides have approximately equal lengths.

10. The machine of claim 1, wherein the yarn feed points are spaced equidistantly about the circumference of the feeding wheel.

11. The machine of claim 1, further comprising a plurality of warp yarn guides configured to deliver warp yarns, wherein the warp yarns are approximately parallel to the helical yarn guides.

12. The machine of claim 1, wherein the first yarn feeding wheel and the plurality of yarn package holders are independently rotatable.

13. The machine of claim 1, further comprising an adhesive applicator, wherein the adhesive applicator is approximately parallel to the fabric take up and is located further from the helical yarn guides than the fabric take up.

* * * * *